US012317968B2

(12) United States Patent
Nehmadi

(10) Patent No.: US 12,317,968 B2
(45) Date of Patent: Jun. 3, 2025

(54) ACCESSORY FOR WEAR HAVING PLURAL TAILS

(71) Applicant: IALLO Inc., Venice, CA (US)

(72) Inventor: Gezel Ghazal Nehmadi, Venice, CA (US)

(73) Assignee: IALLO Inc., Venice, CA (US)

( * ) Notice: Subject to any disclaimer, the term of this patent is extended or adjusted under 35 U.S.C. 154(b) by 0 days.

(21) Appl. No.: 18/495,337

(22) Filed: Oct. 26, 2023

(65) Prior Publication Data

US 2025/0134219 A1 May 1, 2025

(51) Int. Cl.
*A44C 15/00* (2006.01)

(52) U.S. Cl.
CPC ..... *A44C 15/003* (2013.01); *A44C 15/0005* (2013.01)

(58) Field of Classification Search
CPC ..... A44C 15/003; A44C 15/0005; A44C 15/0045; A44C 15/005; A44C 15/0055; A44C 15/006; A44C 15/00; A41D 25/005; A41D 25/04; A41D 25/00; A41D 23/00; A41D 23/004
USPC ..... 224/257; D2/501, 500; D11/3; 63/3, 4, 63/3.1; 132/212, 273, 275, 105
See application file for complete search history.

(56) References Cited

U.S. PATENT DOCUMENTS 3,087,277 A * 4/1963 McCook ..... A63H 33/006 224/625
5,351,346 A * 10/1994 Hodges, Jr. ..... A47K 3/281 224/220
6,966,472 B2 * 11/2005 Szarek ..... A63H 33/006 446/28
7,503,079 B1 * 3/2009 Fletcher ..... A42B 5/00 2/207
2004/0163660 A1 * 8/2004 Kellmann ..... A41G 5/0073 132/275
2005/0109361 A1 * 5/2005 Klug ..... A45D 8/34 132/275
2008/0173323 A1 * 7/2008 Lloyd ..... A45D 8/36 132/273
2016/0381447 A1 * 12/2016 Kattine ..... H04R 1/105 224/183

* cited by examiner

*Primary Examiner* — Jack W Lavinder
(74) *Attorney, Agent, or Firm* — Leason Ellis LLP

(57) ABSTRACT

An accessory secures items about the about the head, neck or waist of a user. The accessory drapes from the user and has plural elongate, flexible elements with at least first and second groupings having different lengths. Each of the elements extends to free ends separated from each other by a central region. A first grouping of the elements is shorter than the second grouping. All of the groupings are secured together in the central region. A connector is attached to one or both of the free ends of at least one of the elements. A termination is at one or both of the free ends of at least a portion of the plurality of elements. An item is selectively attachable to the connector. In certain implementations, a slidable element is mounted to at least one of the elements which is manually movable to reveal or conceal an attached item.

19 Claims, 2 Drawing Sheets

ACCESSORY FOR WEAR HAVING PLURAL TAILS

FIELD OF THE DISCLOSURE

The present disclosure relates generally to accessories that are worn on or supported by a person's body, and, more particularly, to an accessory that secures one or more items about the head, neck or waist of a user such that the items can be engaged and used while the accessory remains worn on the user.

BACKGROUND OF THE DISCLOSURE

Fashion accessories can take a variety of forms including scarves, necklaces, jewelry of various kinds and so on. Typically, the accessory has a single purpose of adornment, but sometimes the accessory can store an item. For instance, a locket can be suspended from a necklace and include a photo within. When suspended from a necklace, however, few items can be on the necklace loop and engaging with such items on a necklace is difficult for the wearer to see and enjoy.

On the other hand, often an individual employs any number of portable fashion accessories to transport personal effects. For example, many women carry a purse or pocketbook, and modern trends have seen a growth in the number of similar accessories for men beyond the traditional briefcases and attaches. A variety of items may be stored and contained within such accessories.

What remains needed in the art however are improvements to fashion accessories to enable a user to engage with and utilize items that are being carried or supported by the accessory while the accessory remains worn. The present disclosure addresses these and other needs in the art.

SUMMARY OF THE DISCLOSURE

An accessory secures one or more items about the head, neck or waist of a user. The accessory drapes from the user and has plural elongate, flexible elements with at least first and second groupings having different lengths. Each of the elements extends to first and second free ends separated from each other by a central region. A first grouping of the elements has a length shorter than the length of the second grouping. All of the groupings are secured together in the central region. A connector is attached to one or both of the first and second free ends of at least one of the elements. A termination is at one or both of the first and second free ends of at least a portion of the plurality of elements. An item is selectively attachable to the connector. In certain implementations, a slidable element is mounted to at least one of the elements which is manually movable to reveal or conceal an attached item.

In one or more embodiments consistent with the present disclosure, the accessory has as the connected item ear plugs connected to the first and second free ends of at least one of the elongate, flexible elements in the first grouping, wherein the ear plugs each have an operative end positionable for insertion into a respective ear of a person while remaining connected to the elongate, flexible element.

In one or more embodiments consistent with the present disclosure, the accessory has as the connected item glasses holders connected to the first and second free ends of at least one of the elongate, flexible elements in the first grouping, wherein the glasses holders each have an operative end configured to engage and secure a temple member of a pair of glasses while remaining connected to the elongate, flexible element.

In one or more embodiments consistent with the present disclosure, the accessory has an illuminable element supported by at least one of the elongate, flexible elements. In a more particular implementation, the illuminable element comprises a string of lights woven or interleaved within and about the supporting elongate, flexible element. In a different, more particular implementation, the illuminable element comprises an electroluminescent tube.

In one or more embodiments consistent with the present disclosure, the accessory has one or more charms supported on at least one of the elongate, flexible elements, wherein the charms can slide along the element and is retained by the termination. In a more particular implementation, the charm has an aperture and wherein the charms are supported by threading the aperture of the charm over the elongate, flexible element. In a different, more particular implementation, the charm has an open position in which it is mountable and removable from and a closed position in which it is retained on the elongate, flexible element.

In one or more embodiments consistent with the present disclosure, the elongate, flexible elements comprise fabric. In more particular implementations, the fabric is selected from the group consisting of: a reflective fabric, a water absorbent fabric, and perforated rubber. In still more particular implementations, at least one of the elongate, flexible elements is braided. In the same or separate implementations, at least one of the elongate, flexible elements includes perforated rubber and wherein the perforations are sized and shaped to receive and secure a charm to the rubber element.

In one or more embodiments consistent with the present disclosure, the accessory further comprises a scrunchie which is utilized to secure together the elongate, flexible elements of all groupings in the central region. In implementations that include the scrunchie, the scrunchie can further comprise a securable pocket within the scrunchie which is accessible by a user.

In one or more embodiments consistent with the present disclosure, the accessory further comprises a sleeve surrounding at least one of the items connected to the connector adjacent a free end of a particular one of the elongate, flexible elements, wherein the sleeve is manually movable to selectively reveal the item or to conceal the item.

Further, consistent with the present disclosure, in each of the implementations described herein one or more of the connectors provided are selected from the group consisting of: a releasable ball and joint connector, a magnetic bayonet clasp, and a screw-clasp connector.

Further, consistent with the present disclosure, in each of the implementations described herein, the item attached, attachable or detachable from one or more of the elongate, flexible elements is selected from the group consisting of: a whistle, an air tag, a battery charger, a clamp, a lighter holder, a spoon, a container, a key, a keyfob, a badge, a cigarette holder, and a retractable cord.

Further, consistent with the present disclosure, in each of the implementations described herein, there can be a third grouping of elongate, flexible elements having a different length than the first and second groupings, also having first and second free ends separated by the central region.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION OF CERTAIN EMBODIMENTS OF THE DISCLOSURE

By way of overview and introduction, the present disclosure concerns an accessory, in particular, a fashion accessory, upon which multiple items can be secured and accessed by the user who is wearing the accessory.

Figure 1:
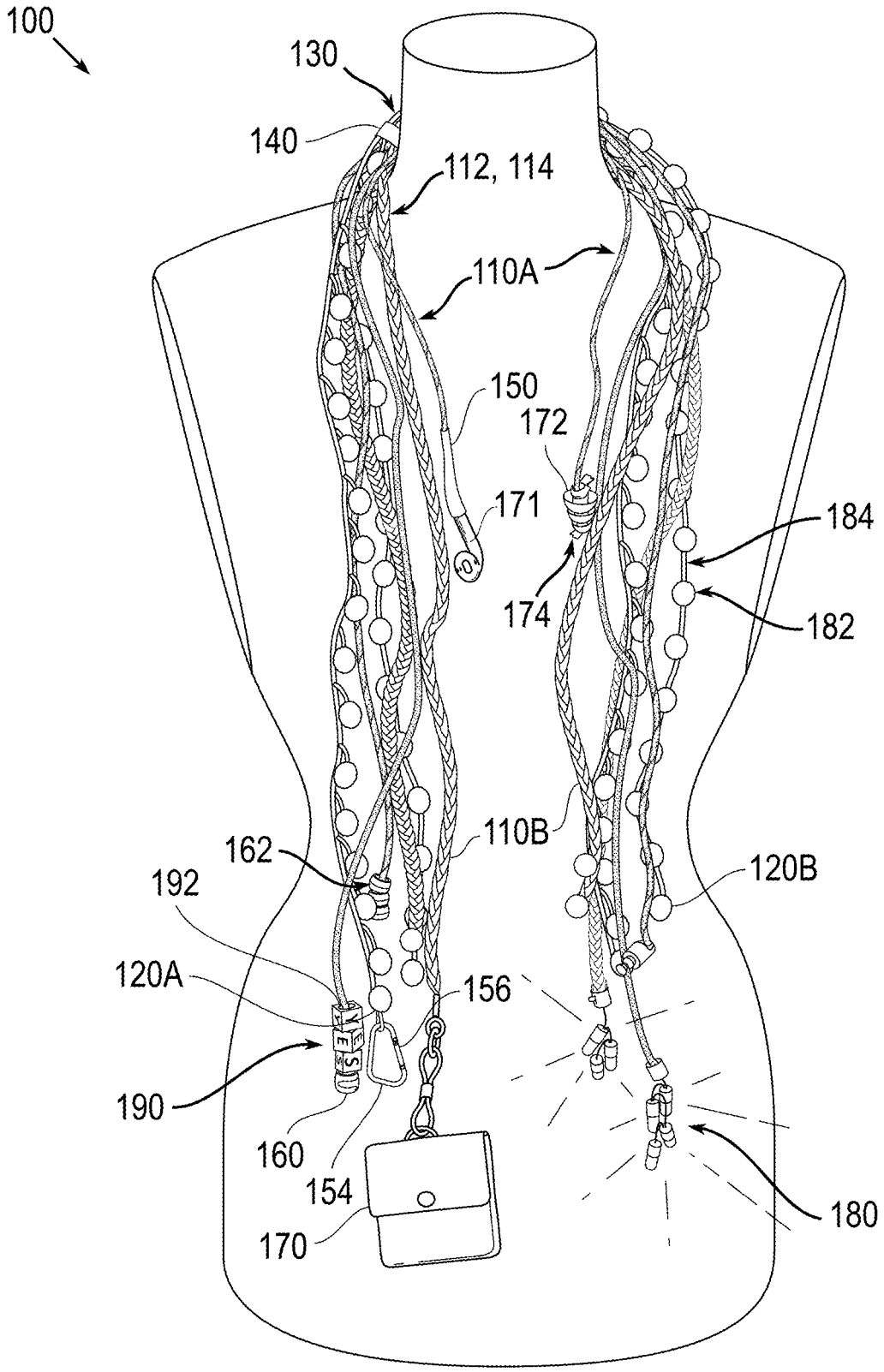
FIG. 1 illustrates an accessory according to one embodiment of the present disclosure shown on a mannequin to provide perspective.

Turning to FIG. 1, an accessory 100 is illustrated shown in a position around the neck region of a mannequin, in accordance with a first embodiment consistent with the present disclosure. As will be appreciated from the following, the accessory 100 of this embodiment or any others referred to herein can be worn in this way, or can be secured to a user's hair (see FIG. 2) or otherwise worn at the user's preference. Common to all embodiments of the accessory contemplated herein, there are a plurality of elongate, flexible elements 110 each leading to free ends 120. In other words, the accessory 100, for instance, differs from a necklace by not having the draped ends attach to one another.

As illustrated in FIG. 1, The elongated flexible elements 110 can comprise a fabric 112, and in some instances within a given embodiment, can by a braided fabric element 114. For instance, the fabric can be a yarn. As well, the fabric selected for use can be fire retardant. In the same or further instances within a given embodiment, the elongated flexible element 110 can comprise a perforated rubber strip 116, strand, cord or the like which is included among the other elongated flexible elements. Also, in the same or further instances within a given embodiment, the fabric can be reflective and that can enhance the appearance of the design but can further cause a photo taken of the wearer to reflect back and potentially obscure some of the captured image. The fabric also can be selected to be water absorbent. In any of these implementations, the fabric can further comprise a fishing string (nylon, PET/PETE, etc.) to add structural integrity to the element 110. Also, one of the elements 110 can be thicker than the rest of them, and that element can include branding to identify and promote the product.

Moreover, the individual elongated flexible elements 110, can comprise or otherwise be adorned throughout their length variations from one element to another. For instance, as described further below, one or more of these elements can be braided, twisted, straight, flat, reflective, illuminated, adorned with baubles, and a given accessory 110 can comprise a combination of a variety of such elements to enhance the appearance of the accessory. In part, the color choice for one or more elements can be preselected to satisfy certain aesthetic criteria, such as to demonstrate school spirit by using a school's set of colors, to demonstrate an affiliation by using, for instance, a sorority's color scheme, or to create a more refined look such as by selecting gold and silver for a given implementation. Whatever color scheme is chosen, that in and of itself is not part of the invention disclosed here.

Also, as can be appreciated from FIG. 1, and in accordance with a salient aspect of this embodiment, the elongated flexible elements 110 are arranged in at least two groupings 110A, 110B, etc., with each grouping of elongated flexible elements having a different length than the other groupings and with each element having a free end 120A, 120B (more generally, free end 120). In one implementation, for instance, the first grouping 110A has elongated flexible elements that are shorter than the second grouping 110B. The shorter elongated flexible elements, by way of example, can terminate near the pectoral region of a wearer when the accessory is worn about the neck. Also by way of example, the longer elongated flexible elements can terminate near the waist region of a wearer when the accessory is worn about the neck. The different lengths facilitate engagement and use of different items that are attachable to the accessory 100 while it is worn about the neck, as described below. Moreover, the hanging nature of the individual elements, their variations in length, and the variations that can be provided in the materials used for the elements, their texture, color and any adornments, all combine to impart a dynamic to the accessory, particularly when the user moves about, whether walking, dancing, etc. It should be understood that in other implementations, such as where an accessory 200 is worn in the hair (see FIG. 2 and the description below), all of the elongated flexible elements can be of a similar length, for instance, the longer length so that the fee ends 120A, 120B can be grasped by the user while the accessory is in their hair.

The individual elongated flexible elements 110 (commercially to be known as "tails") are separate from one another except for at a central location 130 located between the free ends 120A, 120B of any given strand. In the region of the central location 130, there is a securement 140 that secures the tails together. In FIG. 1, the securement 140 comprises stitching that secures each of the individual elongated flexible elements 110. In a different implementation consistent with the present disclosure, the securement 140 can be achieved without a separate element, for instance, by wrapping the individual elongated flexible elements around each other or by knotting. The securement 140 can comprise a clamp. At least one securement 140 is provided to ensure that the accessory 110 has integrity, and that the individual elements do not slide out of the bundle. In certain implementations there can be more than one securement in and about the central region 130. The reason that the securement 140 is in the central region 130 is to ensure that the free ends 120A, 120B can swing and move freely relative to one another while the accessory 110 is worn.

In the vicinity of each free end 120A, 120B of a given elongated flexible element 110, there is either a connector 150 or a termination 160. The connector and terminations deter fraying of the free ends, but in the case of the connector 150, it enables an item 170 to be attached and detached to a given elongated flexible element 110. The connector has one end which is attached to one or both of the free ends 120A, 120B. The connector has a second end that the user can manipulate in order to attach an item 170 to the accessory or detach the item. In FIG. 1, the item 170 is illustrated as a small purse such as may hold a driver's license, school ID, credit card, debit card, concert ticket, and so on. In other implementations, the item 170 can comprise a container that differs from a purse, such as a cylindrical container for stashing small items. There are a variety of items that can be attached to or with a connector, including, by way of example and not limitation an ear plug 172 with an exposed, operative end 174 that can be inserted into the user's ear, illuminable elements 180, a string of lights 182, an electroluminescent (EL) element 184, charms 190, a whistle 198, spoons, a lighter holder, clamps for holding small objects, a spoon, an air tag, a battery charger, a container such as a cylindrical container, a key, a keyfob, a badge, a cigarette holder, a hand sanitizer dispenser, and a retractable cord device for further items that can be attached to the cord.

Figures 2, 2A:
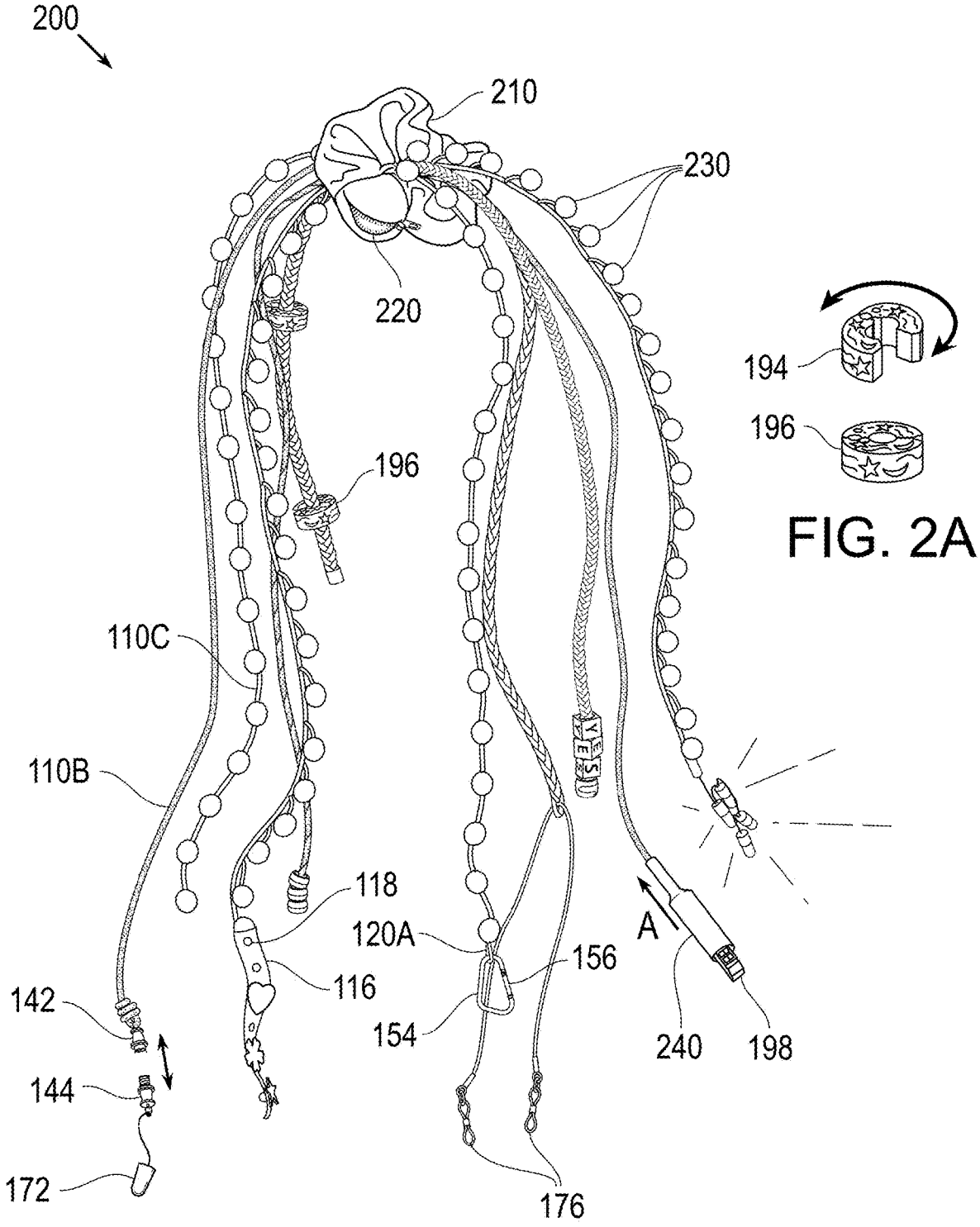
FIG. 2 illustrates an accessory according to another embodiment of the present disclosure shown laying flat and arranged in a generally U-shape as might be worn around a waist, a neck or attached to hair of a user.
FIG. 2A is a detail view of two charms of the type that can open and close, with one shown in an open position and the other shown closed.

Depending on the item to be attached and detached, the item can be attached on a short element 110A, a long element 110B, or an element of intermediate length compared to the short and long elements (110C; see FIG. 2). In implementations in which the accessory 100 includes the illuminable element 180, it is supported by at least one of the elongate, flexible elements such as when the illuminable element comprises a string of lights 182 woven or interleaved within and about the supporting elongate, flexible element. Alternatively or in addition, the illuminable element itself can comprise one of the elongated flexible elements 110, such as in embodiments in which one or more of the elongated flexible elements 110 comprise an electroluminescent tube 184. In that case, it need not be woven or interleaved within and about any other elongate, flexible element.

The connector 150 can take on a variety of forms. In FIG. 1, connector 150 is shown as a flexible sleeve 152 that can be stretched over the dangling (antenna/circuitry) end of an ear bud 171 (that is, a music/communication speaker that is worn in the ear). When attached to an elongated flexible element 110A of the shorter grouping, the ear bud 171 dangles from the accessory in and around the pectoral region and is located for easy grasping and insertion into the ear. The connection to the accessory 110 better ensures that the ear bud 171 is not misplaced or dropped while dancing, jogging, walking, and so on. It should be understood that while one ear bud 171 is shown, and that one ear plug 172 is shown on a different elongated element 110, in practice these items 170 are connected in pairs and showing one of each is just to demonstrate the variety of items that can be attached, and, of course, other ear protection or ear-related accessories can be attached to a suitable connector such as connector 152. In the same or other implementations consistent with this disclosure, a carabiner 154 can be used as the connector, with the carabiner being looped through an end 120 of the elongated flexible element 110, and having an arm 156 that is spring biased to retain the carabiner in a closed position, but which can be urged open for attaching one or more items 170. In certain implementations, the accessory 100, 200 can be provided with tools that a user can use to attach whatever they wish to the product. More generally, the connector 150 can comprise a variety of conventional connectors, such as a releasable ball and joint connector, a magnetic bayonet clasp, a screw-clasp connector, an eyeglass strap with anti-slip adjustable rubber connectors 176 (see FIG. 2) that engage the temple members of a pair of glasses, and so on. In the case of the connector comprising glasses holders, each can have an operative end configured to engage and secure a temple member of a pair of glasses while remaining connected to the elongate, flexible element 110.

The connector itself can be of any conventional design, and the foregoing list is representative of some devices that would be suitable for the accessory 100. A light weight, easy to connect connector is a better choice for the accessory 100, and some connectors can have a two-part construction, with one part attached to the element 110 and the other attached to a given item 170, with those two parts being selectively attachable to secure attach the item 170 to the element and selectively detachable, for instance, to enable the user to hand the item 170 to someone nearby.

For one or more of the elements, instead of a connector 150, there can be the termination 160 at one or both ends 120A, 120B. The termination can be a knot 162, a crimped element 164 (see FIG. 2), or a variety of devices to terminate the end of the element. The termination, in certain implementations, can be undone and redone by a user, for instance, to attach a charm 190 which has an aperture 192 that can be threaded onto the element 110 and which can slide along the element and be retained by the termination 160. As will be appreciated by those familiar with charms, some charms include a hinge that enable it to move between an open position (see FIG. 2A, 194) and a closed position 196. When such charms are used, they can be attached and detached from along the elongated flexible element 110 without disrupting (undoing, etc.) the termination 160. Also, some charms 190 can be fixed to the elongate, flexible element 110, such as for branding purposes.

Turning now to FIG. 2, an alternative embodiment is illustrated which is substantially the same as the embodiment in FIG. 1 with the principal difference being that the securement 140, which in the first embodiment comprises a stitching connecting the elongate, flexible elements 110, whereas in this embodiment the securement comprises a scrunchie 210 which attaches all of the groupings of the elongate, flexible elements 110 to together in the central region 130. The scrunchie can be of conventional design in some implementations and can be made of a variety of materials. For instance, the scrunchie 210 can have an exterior made of velvet and other material that imparts an elastic effect to the scrunchie 210 for placement in hair, about a forearm, etc. As illustrated, the scrunchie can include a pocket selectively accessible or closed by movement of a closure 220 such as a zipper.

FIG. 2 also shows one of the elongate, flexible elements 110 implemented as a ribbon having a series of small, decorative pom-poms 230 (also known as toories or bobbles). The pom-poms can comprise yarn or other fabric and can extend along all or only part of a given elongate, flexible element 110.

With further reference to FIG. 2, one of the elongate, flexible elements 110 includes a rubber portion 116, though the entire element 110 can comprise a rubber component in certain implementations consistent with the invention, and several of the elements 110 can comprise a rubber component. The rubber component 116 can include perforations 118 and the perforations can be sized and shaped to engagingly receive a charm 190, similar to the types of charms known as JIBBITZ™ which can be fit within CROCS™ shoes, and wherein the perforations are sized and shaped to momentarily, elastically stretch under a stretching force in order to receive the charm and thereafter secure the charm by the perforation returning to its size at rest, when no further stretching force is applied.

FIG. 2 also shows a slidable sleeve 240 which is seated near the end 120 of one of the elongate, flexible elements 110. The sleeve nominally slides downward with gravity to cover the item 170 attached to the element 110, such as a whistle 198, as illustrated, but since other items can be connected or interchanged on any given element 110, the slidable sleeve 240 can cover a lighter or lighter holder, a spoon, or an alligator ("roach") clip, for instance, enabling the user to generally hide some of the objects 170 attached to the accessory 100, 200 of a given embodiment or implementation. The sleeve 240 can surround the item 170 when connected to the element 110, and be manually moved to selectively reveal the item or to conceal the item.

With one last reference to FIG. 2, while a variety of connectors 150 can be utilized, as previously noted, FIG. 2 shows one particularly advantageous style of connector which has two parts: a first part 242 that is connected to the elongate, flexible element 110, at the end 120A, and a second part 244 that connects to an item, for instance, the earbud 172 previously mentioned. The parts 242, 244 can connect to one another in a variety of ways. The illustrated connector in this regard has the parts threaded for a threaded connection, but other two-part connectors can similarly have one part connected to the element 110 and another part connected to a given item 170 with their mutual connection being engaged and disengaged in other ways, such as by a spring-biased trigger clasp, a bayonet in which the user must push and turn the elements, a ball and socket arrangement with a spring or threaded securement, and so on.

In implementations in which the accessory 100 is to be worn about the waist, a connector such as the carabiner 154 can be used to secure the free end 120 of one or more of the elements to another free end for use in this way.

It is to be understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. An accessory for securing one or more items about the head, neck or waist of a user, comprising:

a plurality of elongate, flexible elements comprising at least first and second groupings, the plurality of elongate, flexible elements in the first grouping have a different length than the plurality of elongate, flexible elements in the second grouping, wherein each of said plurality of elongate, flexible elements in said first and second groupings have first and second free ends separated by a central region, wherein the plurality of elongate, flexible elements in the first grouping have a shorter length than the plurality of elongate, flexible elements in the second grouping and wherein the plurality of elongate, flexible elements in the first grouping and the plurality of elongate, flexible elements in the second grouping are secured together in the central region, a connector attached to one or both of the first and second free ends of at least one of the elongate, flexible elements;

a termination at one or both of the first and second free ends of at least a portion of the plurality of elongate, flexible elements; and an item selectively attachable to the connector.

2. The accessory as in claim 1, further comprising ear buds or ear plugs connected to the first and second free ends of at least one of the plurality of elongate, flexible elements in the first grouping, wherein the ear buds or ear plugs each have an operative end positionable for insertion into a respective ear of a person while remaining connected to the at least one of the plurality of elongate, flexible elements in the first grouping.

3. The accessory as in claim 1, further comprising glasses holders connected to the first and second free ends of at least one of the plurality of elongate, flexible elements in the first grouping, wherein the glasses holders each have an operative end configured to engage and secure a temple member of a pair of glasses while remaining connected to the at least one of plurality of elongate, flexible elements in the first grouping.

4. The accessory as in claim 1, further comprising an illuminable element supported by at least one of the plurality of elongate, flexible elements.

5. The accessory as in claim 4, wherein the illuminable element comprises a string of lights woven or interleaved within and about the at least one of the plurality of elongate, flexible elements that supports the illuminable element.

6. The accessory as in claim 4, wherein the illuminable element comprises an electroluminescent tube.

7. The accessory as in claim 1, further comprising one or more charms supported on at least one of the plurality of elongate, flexible elements, wherein the one or more charms can slide along the at least one of the plurality of elongate, flexible elements and is retained by the termination.

8. The accessory as in claim 7, wherein the one or more charms has an aperture and wherein the one or more charms are supported by threading the aperture of the one or more charms over the at least one of the plurality of elongate, flexible elements.

9. The accessory as in claim 7, wherein one or more charms has an open position in which it is mountable and removable from and a closed position in which it is retained on the at least one of the plurality of elongate, flexible elements.

10. The accessory as in claim 1, wherein the the plurality of elongate, flexible elements comprise fabric.

11. The accessory as in claim 10, wherein the fabric is selected from the group consisting of: a reflective fabric, a water absorbent fabric, and perforated rubber.

12. The accessory as in claim 1, wherein at least one of the at least one of the plurality of elongate, flexible elements is braided.

13. The accessory as in claim 1, wherein at least one of the at least one of the plurality of elongate, flexible elements includes a perforated rubber having perforations and wherein the perforations are sized and shaped to receive and secure a charm to the perforated rubber element.

14. The accessory as in claim 1, further comprising a scrunchie, and wherein the plurality of elongate, flexible elements of the first and second groupings are secured together in the central region to the scrunchie.

15. The accessory as in claim 14, further comprising a securable pocket within the scrunchie which is accessible by a user.

16. The accessory as in claim 1, further comprising a sleeve surrounding the item connected to the connector and manually movable to selectively reveal the item or to conceal the item.

17. The accessory as in claim 1, wherein the connector is selected from the group consisting of: a releasable ball and joint connector, a magnetic bayonet clasp, and a screw-clasp connector.

18. The accessory as in claim 1, wherein the item is selected from the group consisting of: a whistle, an air tag, a battery charger, a clamp, a lighter holder, a spoon, a container, a key, a keyfob, a badge, a cigarette holder, and a retractable cord.

19. The accessory as in claim 1, wherein there is a third grouping of elongate, flexible elements having a different length than the length of each of the plurality of elongate, flexible elements in the first and second groupings and having first and second free ends separated by the central region.

* * * * *